US007600403B2

(12) United States Patent
Chang

(10) Patent No.: US 7,600,403 B2
(45) Date of Patent: Oct. 13, 2009

(54) TOP LOADED WASHING MACHINE HAVING DRUM WITH HORIZONTAL AXIS OF ROTATION

(75) Inventor: Jae won Chang, Gunpo-si (KR)

(73) Assignee: LG Electronics Inc., Seoul (KR)

( * ) Notice: Subject to any disclaimer, the term of this patent is extended or adjusted under 35 U.S.C. 154(b) by 678 days.

(21) Appl. No.: 11/265,273

(22) Filed: Nov. 3, 2005

(65) Prior Publication Data

US 2006/0096332 A1 May 11, 2006

(30) Foreign Application Priority Data

Nov. 5, 2004 (KR) ..... 10-2004-0089834

(51) Int. Cl.
*D06F 17/00* (2006.01)

(52) U.S. Cl. ..... 68/196; 68/12.24; 68/24

(58) Field of Classification Search ..... 68/12.01, 68/12.24, 24, 139, 140, 196
See application file for complete search history.

(56) References Cited

U.S. PATENT DOCUMENTS

2002/0166349 A1* 11/2002 Lim et al. ..... 68/23.7
2004/0129035 A1* 7/2004 Chang ..... 68/23 R

FOREIGN PATENT DOCUMENTS

| | | |
|---|---|---|
| BE | 6 587 44 | 5/1965 |
| CN | 1511997 A | 7/2004 |
| CN | 1536149 A | 10/2004 |
| EP | 1 433 891 | 6/2004 |
| KR | 10-0437795 | 9/2003 |

OTHER PUBLICATIONS

Machine Translation of Kim. KR 10-0437795, Sep. 2003.*

* cited by examiner

*Primary Examiner*—Michael Barr
*Assistant Examiner*—David Cormier
(74) *Attorney, Agent, or Firm*—Birch, Stewart, Kolasch & Birch, LLP

(57) ABSTRACT

A washing machine includes a tub fixedly installed in a cabinet, a drum rotatably installed in the tub for containing laundry and provided with an opening formed through the outer circumferential surface thereof so that the laundry is taken into and out of the drum through the opening. A drum door is provided at the opening of the drum and moves in the circumferential direction of the drum relative to the drum to open and close the opening of the drum. A driving unit rotates the drum.

18 Claims, 7 Drawing Sheets

TOP LOADED WASHING MACHINE HAVING DRUM WITH HORIZONTAL AXIS OF ROTATION

This application claims the benefit of Korean Patent Application No.10-2004-89834, filed on Nov. 5, 2004, which is hereby incorporated by reference as if fully set forth herein.

BACKGROUND OF THE INVENTION

1. Field of the Invention

The present invention relates to a washing machine, and more particularly, to a washing machine having a structure such that laundry is conveniently taken into and out of the washing machine.

2. Discussion of the Related Art

Generally, a washing machine performs washing, rinsing, and dehydrating operations by filling the lower portion of the inside of a tub with water and detergent, placing laundry into a drum installed in the tub, and rotating the drum.

Such a washing machine is an apparatus for eliminating dirt from the laundry using proper detergent and mechanical force.

Particularly, a drum washing machine, in which a drum is horizontally installed in a tub, washes laundry by rotating the drum by means of the driving force of a motor. Accordingly, the drum washing machine does not cause entanglement of the laundry and damage to the laundry, consumes a small quantity of washing water, and exerts beating and rubbing effects.

It is necessary to conveniently take laundry into and out of the above washing machine. Accordingly, the development of a washing machine having a structure such that laundry is conveniently taken into and out of the washing machine is required.

SUMMARY OF THE INVENTION

Accordingly, the present invention is directed to a washing machine having a structure such that laundry is conveniently taken into and out of the inside of the washing machine.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a washing machine comprises a tub fixedly installed in a cabinet; a drum rotatably installed in the tub for containing laundry, and provided with an opening formed through the outer circumferential surface thereof so that the laundry is taken into and out of the drum through the opening; a drum door provided at the opening of the drum, and moving in the circumferential direction of the drum relatively to the drum to open and close the opening of the drum; and a driving unit for rotating the drum.

The drum door rotates centering on a rotary axis of the drum to open and close the opening of the drum.

Preferably, the drum door is connected to the driving unit to automatically open and close the opening of the drum.

For this reason, the washing machine further comprises a clutch unit for selectively interconnecting the driving unit and the drum to selectively transmit driving force of the driving unit to the drum.

The driving unit comprises a driving motor; and a door driving shaft, one end of which is connected to a rotor of the driving motor and the other end of which is connected to a rotary center of the drum door, to transmit the driving force of the driving motor to the drum door.

The drum comprises a drum driving shaft, one end of which is connected to a rotary center of the drum and the other end of which is selectively connected to the driving unit by the clutch unit, and being concentric with the door driving shaft.

The drum door is movable along the inner circumferential surface of the drum in the circumferential direction, and the door driving shaft passes through the drum driving shaft in the axial direction.

The clutch unit is installed between the driving motor and the drum driving shaft such that the clutch unit moves in the axial direction of the drum driving shaft, transmits the driving force of the driving unit to the drum driving shaft so that the drum driving shaft is rotated simultaneously with the rotation of the door driving shaft, when the washing machine is operated in washing and dehydration modes, and interrupts the transmission of the driving force of the driving motor to the drum driving shaft, when the drum door is opened.

For this reason, the clutch unit comprises a coupler installed between the driving motor and the drum driving shaft such that the coupler moves in the axial direction of the drum driving shaft, to selectively interconnect the drum driving shaft and the door driving shaft; and a coupler driving portion for moving the coupler.

The coupler moves in the axial direction of the drum driving shaft by the coupler driving portion under the condition that the coupler is connected to the drum driving shaft by serrations, and is selectively connected to the door driving shaft.

One end of the coupler is separated from the door driving shaft and the other end of the coupler is connected to one end of the tub so that the position of the opening of the drum is not changed when the drum door is opened.

More specifically, the coupler comprises a first serration formed on one end of the coupler and selectively connected to a driving serration formed in the door driving shaft; a second serration engaged with a serration formed in the drum driving shaft; and a third serration formed on the other end of the coupler and selectively connected to a fixing serration formed in one end of the tub.

The coupler driving portion comprises at least one electromagnet for moving the coupler to control the interconnection between the coupler and the door driving shaft.

More specifically, the coupler driving portion comprises at least one electromagnet formed on one of the tub and the coupler; a magnetic member formed on the other one of the tub and the coupler for moving the coupler in one direction by the electromagnetic interaction with the electromagnet; and an elastic member, one end of which is supported by the coupler and the other end of which is supported by the rotor of the driving motor.

The magnetic member moves the coupler when current is applied to the electromagnet, cuts the interconnection between the coupler and the driving unit, and interconnects the coupler and one end of the tub so as to prevent the rotation of the drum driving shaft when the drum door is opened.

The washing machine further comprises an alignment unit for aligning the opening of the drum to coincide with an opening formed through the tub.

The washing machine further comprises at least one latching protrusion formed on one edge of the opening of the drum; and at least one latching hook formed on one edge of the drum door and latched onto the latching protrusion when the drum door is closed.

The washing machine further comprises at least one subsidiary latching protrusion formed on the other edge of the opening of the drum; and at least one subsidiary latching hook formed on the other edge of the drum door and latched onto the subsidiary latching protrusion.

The washing machine further comprises a weight provided on the subsidiary latching hook for separating the subsidiary latching hook from the subsidiary latching protrusion by its own weight when the drum is stopped and connecting the subsidiary latching hook to the subsidiary latching protrusion by the centrifugal force when the drum is rotated.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings.

Wherever possible, the same reference numbers will be used throughout the drawings to refer to the same or like parts.

Figure 1:
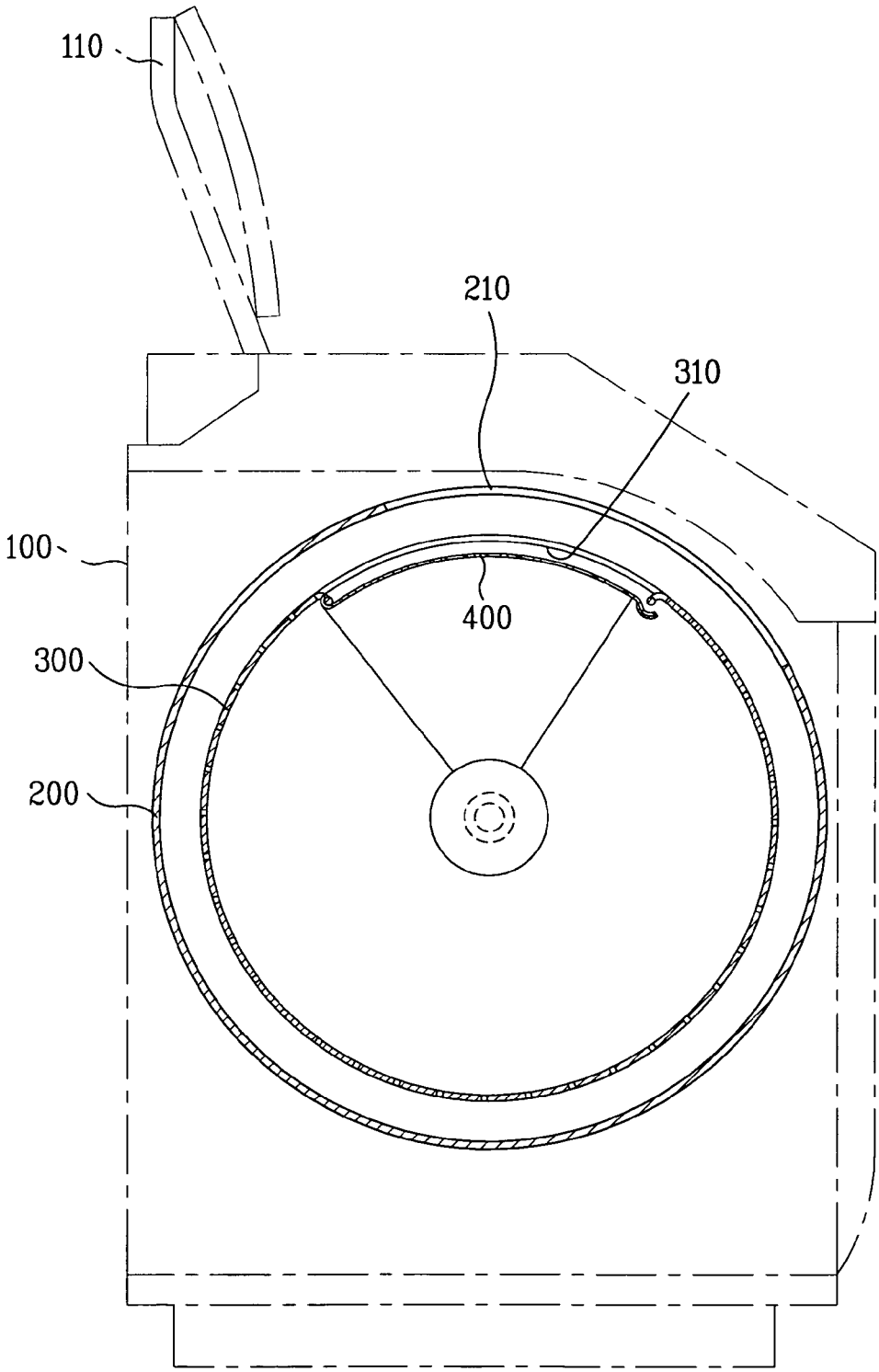
FIG. 1 is a schematic longitudinal sectional view of a washing machine in accordance with an embodiment of the present invention.
Figure 2:
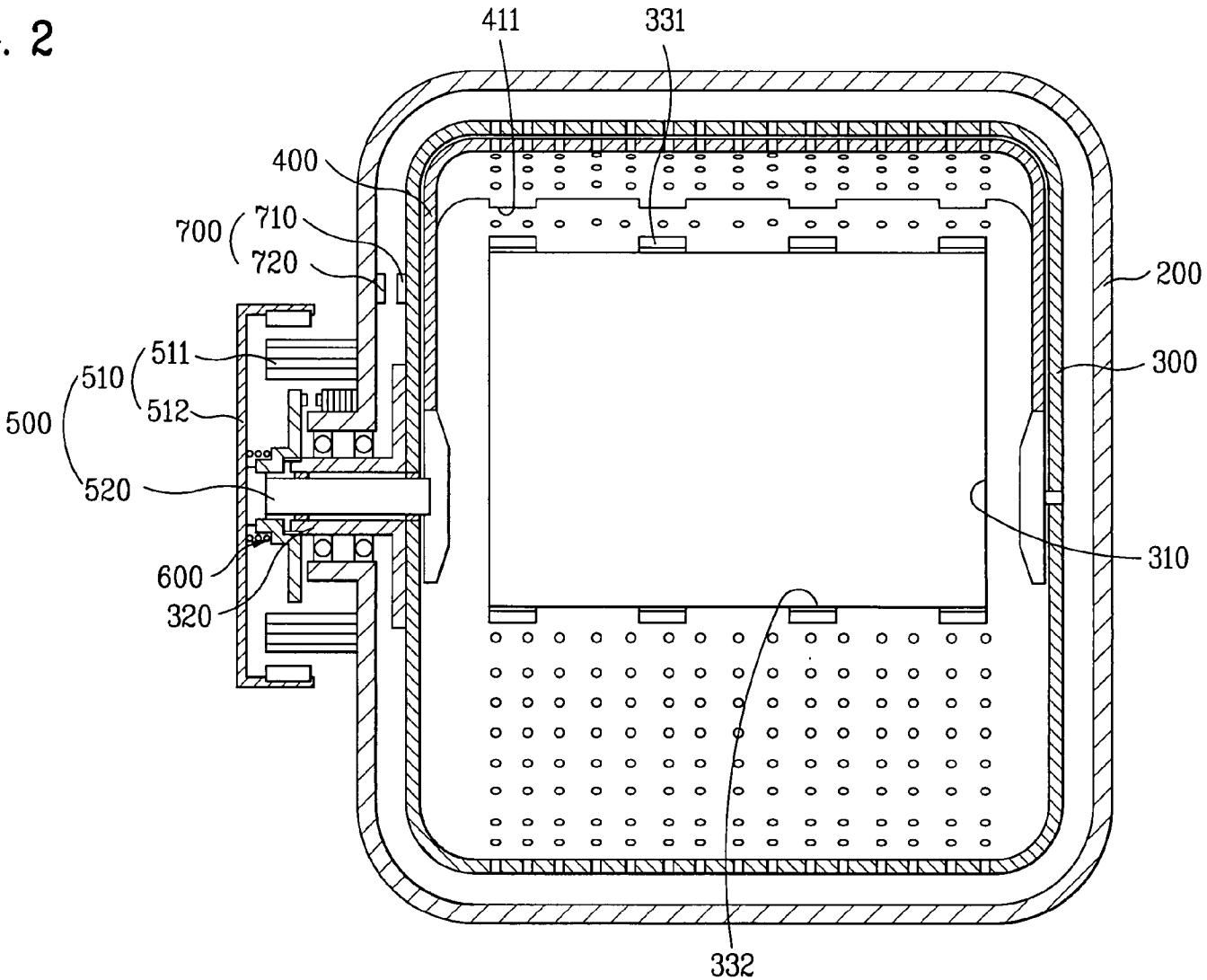
FIG. 2 is a schematic sectional view of the washing machine in accordance with the embodiment of the present invention.

First with reference to FIGS. 1 and 2, a washing machine of the present invention comprises a cabinet 100 forming the external appearance of the washing machine, a tub 200 fixedly installed in the cabinet 100, and a drum 300 rotatably installed in the tub 200.

In this embodiment, a laundry inlet port (not shown), through which laundry is taken into and out of the cabinet 100, is formed through the cabinet 100, and a foldable cabinet door 110 is rotatably connected to one edge of the laundry inlet port.

The tub 200 contains washing water for washing the laundry. An opening 210 opened towards the laundry inlet port is formed through the outer circumferential surface of the tub 200. The opening 210 is opened and closed by a rotating door or a sliding door (not shown).

Here, the door for opening and closing the opening 210 of the tub 200 serves to prevent the outflow of the washing water and to cause the laundry to be taken into and out of the tub 200.

In this embodiment, in order to allow a user to take the laundry into and out of the inside of the washing machine from the upper part of the washing machine, the laundry inlet port is formed through the upper surface of the cabinet 100, and the opening 210 of the tub 200 is formed through the outer circumferential surface of the upper portion of the tub 200.

An opening 310, through which the laundry is taken into and out of the drum 300, is formed through the outer circumferential surface of the tub 300. In addition to the above constitution, the washing machine of the present invention further comprises a drum door 400 provided at the opening 310 of the drum 300 for opening and closing the opening 310 of the drum 300.

A plurality of through holes for passing the washing water are formed through the drum 300 and the drum door 400, and the drum 300 is rotated by a driving unit 500.

The drum door 400 of the washing machine of the present invention moves in the circumferential direction of the drum 300 relatively to the drum 300, thereby opening and closing the opening 310 of the drum 300.

Here, the motion of the drum door 400 in the circumferential direction of the drum 300 relatively to the drum 300 means the motion of the drum door 400 in the circumferential direction of the drum 300 under the condition that the drum 300 is fixed, the rotation of the drum 300 under the condition that the drum door 400 is fixed, or the rotation of the drum 300 and the drum door 400 in the opposite directions, so that the relative positions of the drum 300 and the drum door 400 are changed.

Since the drum 300 usually has a cylinder-shaped outer circumferential surface, preferably, the drum door 400 has an arc shape.

Accordingly, the drum door 400 slidably moves to open and close the opening 310 of the drum 300, or, as described in this embodiment, rotates centering on a rotary axis of the drum 300 to open and close the opening 310 of the drum 300.

Although this embodiment describes the drum door 400 moves to open and close the opening 310 of the drum 300 by the driving unit 500 rotating the drum 300, the motion of the drum door 400 is not limited thereto.

Here, the opening 310 of the drum 300 is extended in the lengthwise direction of the drum 300 so that the laundry can be easily taken out of the drum 300 through the opening 310.

In addition to the above constitution, the washing machine of the present invention further comprises a clutch unit 600 for selectively interconnecting the driving unit 500 and the drum 300, thereby selectively transmitting the driving force of the driving unit 500 to the drum 300.

The driving unit 500 comprises a driving motor 510 for generating rotary force, and a door driving shaft 520 for interconnecting the driving motor 510 and a rotary center of the drum door 400.

The driving motor 510 comprises a stator 511 fixed to the tub 200, and a rotor 512 rotating around the stator 511.

One end of the door driving shaft 520 is connected to the rotor 512, and the other end of the door driving shaft 520 is connected to the rotary center of the drum door 400. More specifically, the rotor 512, the door driving shaft 520, and the rotary center of the drum door 400 are integrally interconnected.

A drum driving shaft 320, which is selectively connected to the driving unit 500 by the clutch unit 600, is provided at the rotary center of the drum 300.

More specifically, one end of the drum driving shaft 320 is connected to the rotary center of the drum 300, and the other end of the drum driving shaft 320 is selectively connected to the driving unit 500 by the clutch unit 600. Since the drum driving shaft 320 is concentric with the door driving shaft 520, the drum driving shaft 320 and the door driving shaft 520 have a rotary axis in common.

Preferably, the washing machine of the present invention further comprises an alignment unit 700 for aligning the opening 310 of the drum 300 to a designated position when a user wants to take laundry into or out of the drum 300.

That is, the alignment unit 700 allows the opening 310 of the drum 300 to coincide with the opening 210 of the tub 200.

The alignment unit 700 comprises a sensing target portion 710 installed at one side of the outer surface the drum 300, and a position sensor 720 installed at one side of the inner surface of the tub 200 so that the position sensor 720 reacts with the sensing target portion 710.

Accordingly, when the drum 300 is rotated by the driving motor 510 so that the sensing target portion 710 coincides with the position sensor 720, a signal of the position sensor 720 is applied to a controller, and the controller stops the operation of the driving motor 510 so that the opening 310 of the drum 300 coincides with the opening 210 of the tub 200.

Since the laundry inlet port is formed through the upper portion of the cabinet 100 in this embodiment, preferably, the drum 300 is horizontally installed in the tub 200. Accordingly, a washing machine, which will be described hereinafter, denotes a drum washing machine.

Figure 3:
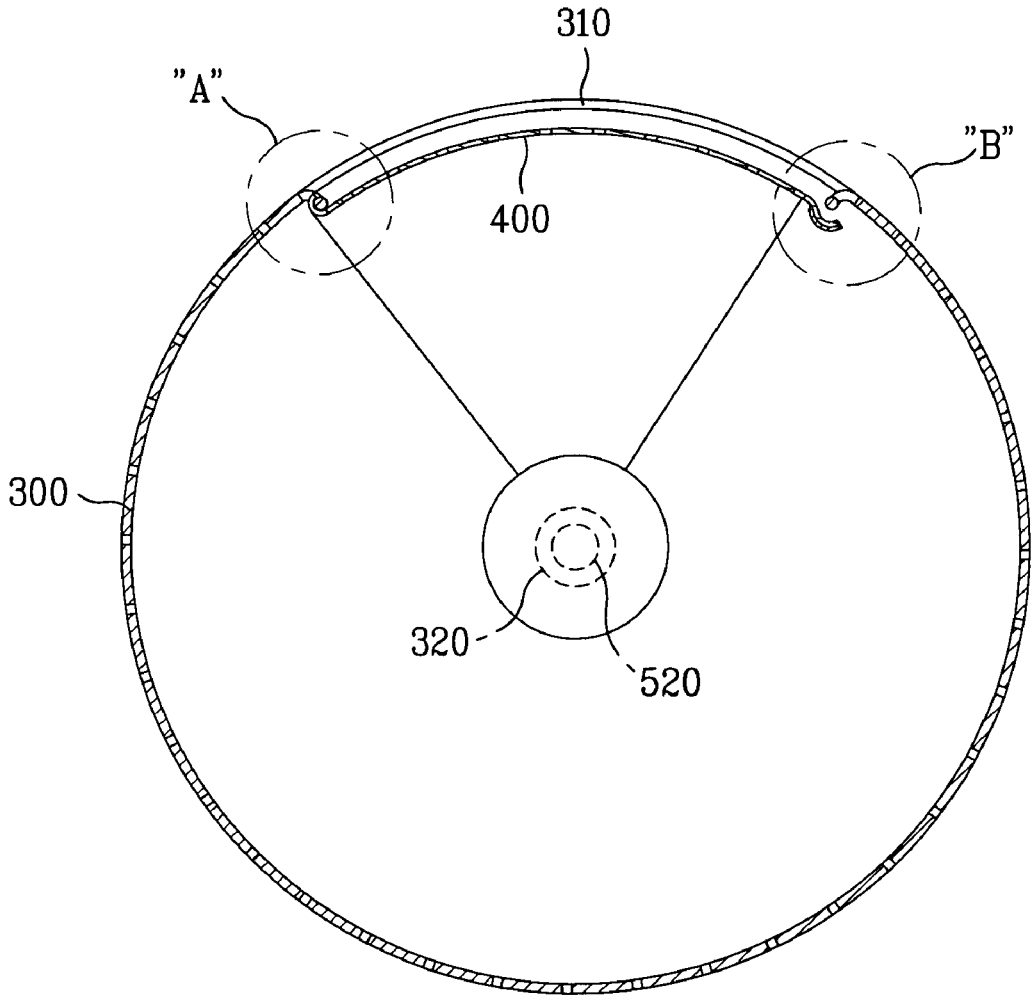
FIG. 3 is a sectional view of a drum of the washing machine in accordance with the embodiment of the present invention.

With reference to FIGS. 2 and 3, at least one latching protrusion 331 is formed on one edge of the opening 310 of the drum 300. At least one latching hook 411, which is latched onto the latching protrusion 331 when the drum door 400 is closed, is formed on one edge of the drum door 400.

Further, at least one subsidiary latching protrusion 332 is formed on the other edge of the opening 310 of the drum 300. At least one subsidiary latching hook 412, which is latched onto the subsidiary latching protrusion 332, is formed on the other edge of the drum door 400.

Figure 4A:
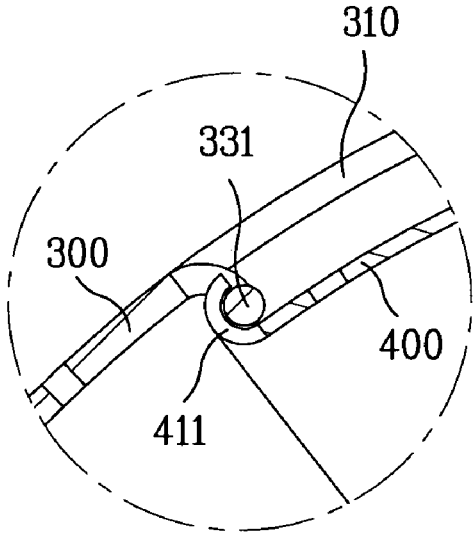
FIGS. 4A and 4B are enlarged views of portions "A" and "B" of FIG. 3.
Figure 4B:
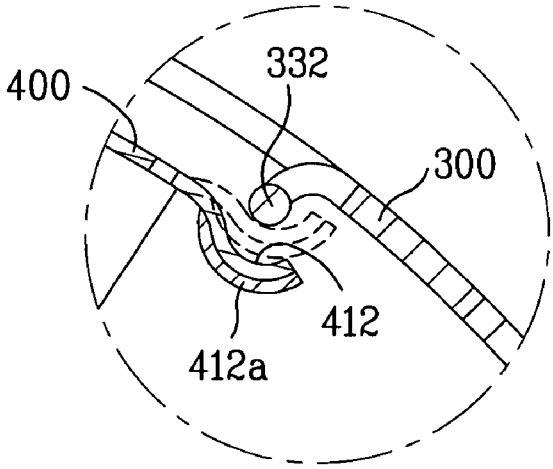

With reference to FIGS. 4A and 4B, in this embodiment, a plurality of the latching protrusions 331 are formed on one edge of the opening 310 of the drum 300, and a plurality of the subsidiary latching protrusions 332 are formed on the other edge of the opening 310 of the drum 300. Further, a plurality of the latching hooks 411 are formed on one edge of the drum door 400, and a plurality of the subsidiary latching hooks 412 are formed on the other edge of the drum door 400. The latching hooks 411 and the subsidiary latching hooks 412 have an approximately semicircular shape.

In this embodiment, the drum door 400 is provided in the drum 300. Accordingly, the drum door 400 is movable in the circumferential direction along the inner circumferential surface of the drum 300 by the driving unit 500, The latching protrusions 331 and the subsidiary latching protrusions 332 are protruded towards the inside of the drum 300, and the latching hooks 411 and the subsidiary latching hooks 412 have a semicircular shape such that the surfaces of the latching hooks 411 and the subsidiary latching hooks 412 facing the inside of the drum 300 are concaved.

Preferably, in addition to the above constitution, the washing machine of the present invention further comprises a weight 412*a* provided on the subsidiary latching hooks 412 for facilitating the opening and closing of the drum door 400.

The weight 412*a* separates the subsidiary latching hook 412 from the subsidiary latching protrusion 332 by its own weight, when the drum 300 is stopped. Further, the weight 412*a* connects the subsidiary latching hook 412 to the subsidiary latching protrusion 332 by the centrifugal force, when the drum 300 is rotated, thereby firmly fixing the drum door 400 to the opening 310 of the drum 300.

Figure 5:
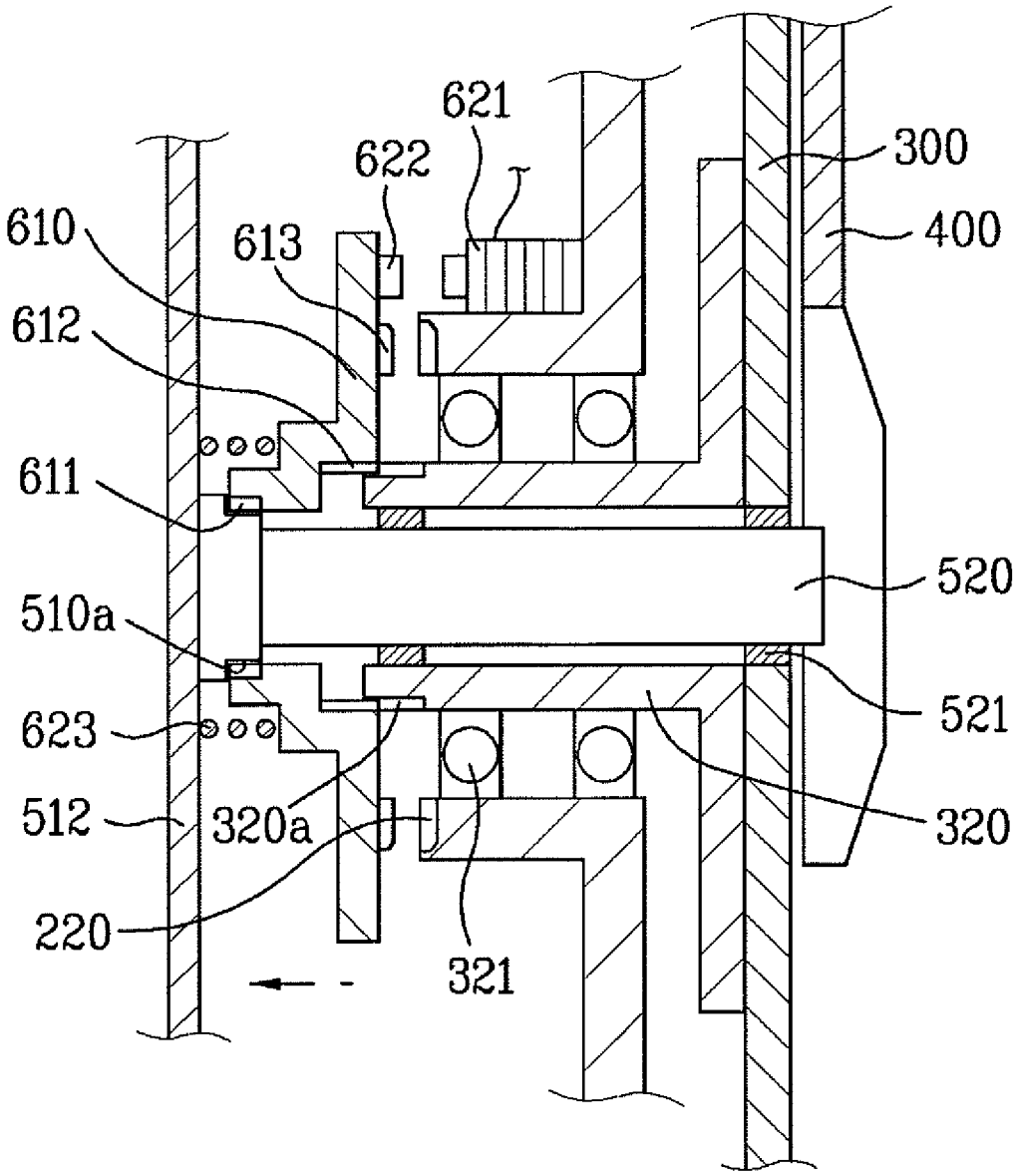
FIG. 5 is a sectional view of a drum door driving device of the washing machine in accordance with the embodiment of the present invention.
Figure 6:
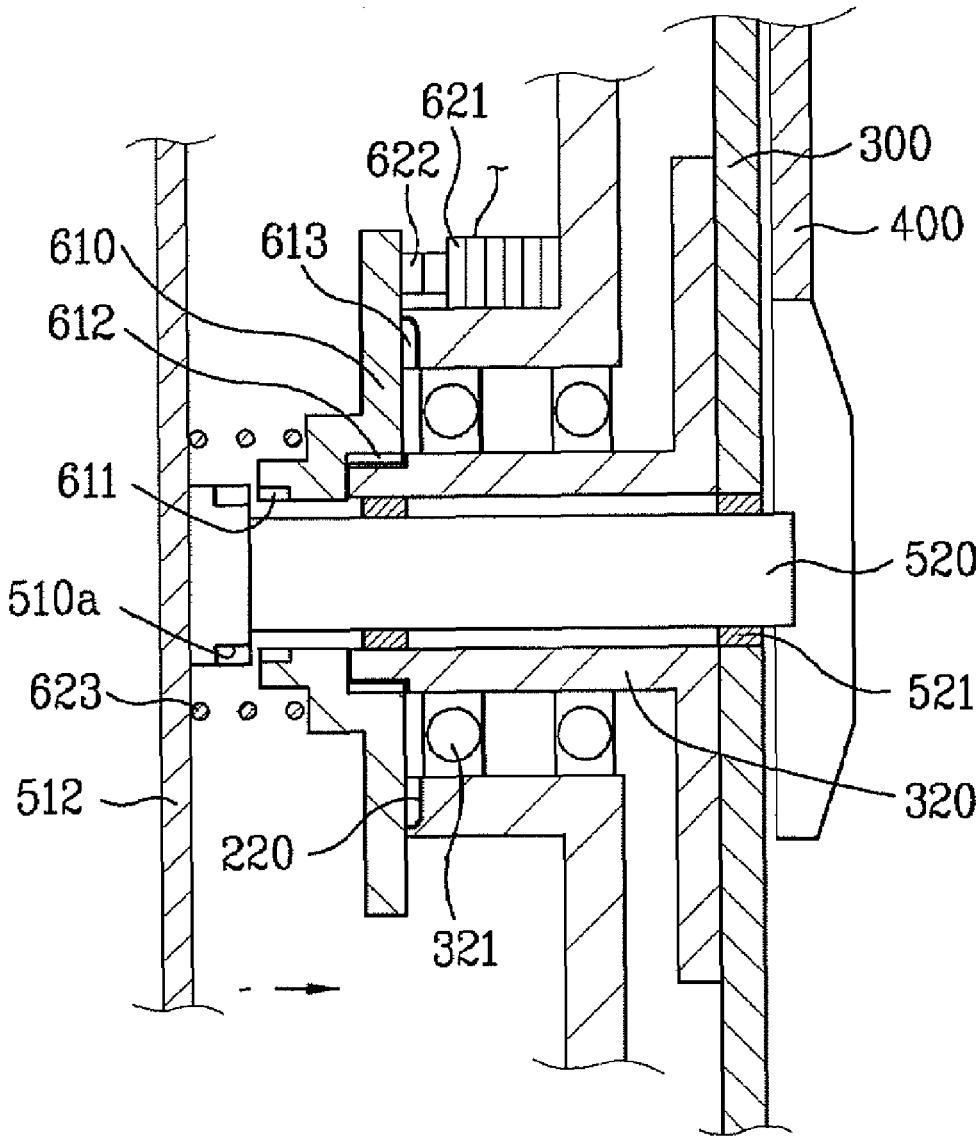
FIG. 6 is a sectional view of the drum door driving device of the washing machine in accordance with the embodiment of the present invention, when a drum door is driven.

As shown in FIGS. 5 and 6, in this embodiment, since the drum door 400 is provided in the drum 300, the drum driving shaft 320 having a hollow structure for rotating the drum 300 is installed outside the door driving shaft 520 for interconnecting the drum door 400 and the driving motor 510. Accordingly, the door driving shaft 520 passes through the drum driving shaft 320 in the axial direction. First bearings 521 are installed between the door driving shaft 520 and the drum driving shaft 320.

Further, second bearings 321 for rotatably fixing the drum 300 to the tub 200 are installed between the drum driving shaft 320 and the tub 200.

The clutch unit 600 transmits the driving force of the driving unit 500 to the drum driving shaft 320 so that the drum driving shaft 320 is rotated simultaneously with the rotation of the door driving shaft 520, when the washing machine is operated in washing and dehydration modes, and interrupts the transmission of the driving force of the driving motor 510 to the drum driving shaft 320, when the drum door 400 is opened.

For this reason, the clutch unit 600 is installed between the driving motor 510 and the drum driving shaft 320 such that the clutch unit 600 moves in the axial direction of the drum driving shaft 320.

More specifically, the clutch unit 600 comprises a coupler 610 for selectively interconnecting the drum driving shaft 320 and the door driving shaft 520, and a coupler driving portion for moving the coupler 610.

The coupler 610 moves in the axial direction of the drum driving shaft 320 by the coupler driving portion under the condition that the coupler 610 is connected to the drum driving shaft 320 by serrations, and is selectively connected to the door driving shaft 520.

More preferably, when the drum door 400 is opened, one end of the coupler 610 is separated from the door driving shaft 520 and the other end of the coupler 610 is connected to one end of the tub 200. Accordingly, the coupler 610 interrupts the transmission of the driving force of the driving motor 510 to the drum 300, thereby preventing the change of the position of the opening 310 of the drum 300.

For this reason, the coupler 610 comprises a first serration 611, a second serration 612, and a third serration 613.

The first serration 611 is formed on one end of the coupler 610, and is selectively connected to a driving serration 510*a* formed in the door driving shaft 520.

The second serration 612 is engaged with a serration 320*a* formed in the drum driving shaft 320. Further, the third serration 613 is formed on the other end of the coupler 610, and is selectively connected to a fixing serration 220 formed in one end of the tub 200.

More specifically, the first serration 611 is formed on the inner circumferential surface of one end of the coupler 610, and is engaged with the teeth-shaped driving serration 510*a* formed in the outer circumferential surface of the door driving shaft 520 so as to rotate the drum 300.

The second serration 612 is formed on the inner circumferential surface of the coupler 610, and is engaged with the serration 320*a* formed in the outer circumferential surface of the drum driving shaft 320. Thereby, the coupler 610 slides by means of the second serration 612 engaged with the serration 320*a* formed in the outer circumferential surface of the drum driving shaft 320.

The third serration 613 is engaged with the fixing serration 220 formed in one end of the tub 220 so as to prevent the rotation of the drum 300.

The coupler driving portion comprises at least one electromagnet 621 for moving the coupler 610 to control the interconnection between the coupler 610 and the door driving shaft 520.

More specifically, the coupler driving portion comprises at least one electromagnet 621 formed on one of the tub 200 and the coupler 610, and a magnetic member 622 formed on the other one of the tub 200 and the coupler 610 for moving the coupler 610 in one direction by the electromagnetic interaction with the electromagnet 621.

The coupler driving portion further comprises an elastic member 623, one end of which is supported by the coupler 610 and the other end of which is supported by the rotor 512 of the driving motor 500.

The elastic member 623 moves the coupler 610 in the opposite direction of the movement of the coupler 610 by the magnetic member 622.

In this embodiment, the electromagnet 621 includes a solenoid fixed to the tub 200 and having magnetic force by electrical energy applied from the outside, and the magnetic member 622 is fixed to the coupler 610.

The elastic member 623 includes a tension spring, which is supported by the rotor 512 of the driving motor 500 and applies elastic force to the coupler 610.

Instead of the above constitution of the coupler driving portion described in the preferred embodiment, the coupler driving portion may be variously modified.

By the above constitution of the coupler driving portion, the magnetic member 622 moves the coupler 610 towards the tub 200 when current is applied to the electromagnet 621, cuts the interconnection between the coupler 610 and the driving unit 500, and interconnects the coupler 610 and one end of the tub 200, thereby preventing the rotation of the drum driving shaft 320 when the drum door 400 is opened.

Hereinafter, the operation of the above drum washing machine of the present invention will be described in detail.

First, in the washing and dehydrating modes of the washing machine, an electrical signal is not applied to the electromagnet 621.

Accordingly, as shown in FIG. 5, the coupler 610 moves towards the rotor 512 by the force of the elastic member 623 so that the first serration 611 is engaged with the driving serration 510*a* of the door driving shaft 520 and the second serration 612 is engaged with the serration 320*a* of the drum driving shaft 320.

When the rotor 512 of the driving motor 500 is rotated under the above state, the door driving shaft 520 and the drum driving shaft 320 are simultaneously rotated, thereby rotating the drum 300 and the drum door 400 in the same direction at the same speed.

Then, as shown in FIG. 3 and FIGS. 4A and 4B, the latching hooks 411 of the drum door 400 are latched onto the latching protrusions 331 of the drum 300, and the subsidiary latching hooks 421 of the drum door 400 are latched onto the subsidiary latching protrusions 332 of the drum 300 by the centrifugal force of the weights 412*a*, thereby preventing the drum door 400 from being separated from the opening 310 of the drum 300.

When a user manipulates an operation unit (not shown) formed on the cabinet 100 so that the drum door 400 is opened under the condition that the washing and dehydrating modes of the washing machine are terminated or the operation of the washing machine is stopped, the driving motor 510 is slowly driven to rotate the drum 300 until the sensing target portion 710 is sensed by the position sensor 720.

When the sensing target portion 710 is sensed by the position sensor 720, the operation of the driving motor 510 is stopped. Here, the opening 310 of the drum 300 is aligned to coincide with the opening 210 of the tub 200.

Then, when current is applied to the electromagnet 621, the electromagnet 621 generates magnetic force larger than the elastic force of the elastic member 623. Thereby, the coupler 610 moves towards the tub 200 by the attractive force between the magnetic member 622 and the electromagnet 621.

Thus, the first serration 611 is separated from the driving serration 510*a* of the door driving shaft 520, and the third serration 613 is engaged with the fixing serration 220 of the tub 200. In this case, the second serration 612 of the coupler 610 slides along the serration 320*a* of the drum driving shaft 300, and then maintains its engaged state.

Accordingly, the drum 300 is restricted by the tub 200, and only the door driving shaft 520 is in a rotatable state.

Figure 7:
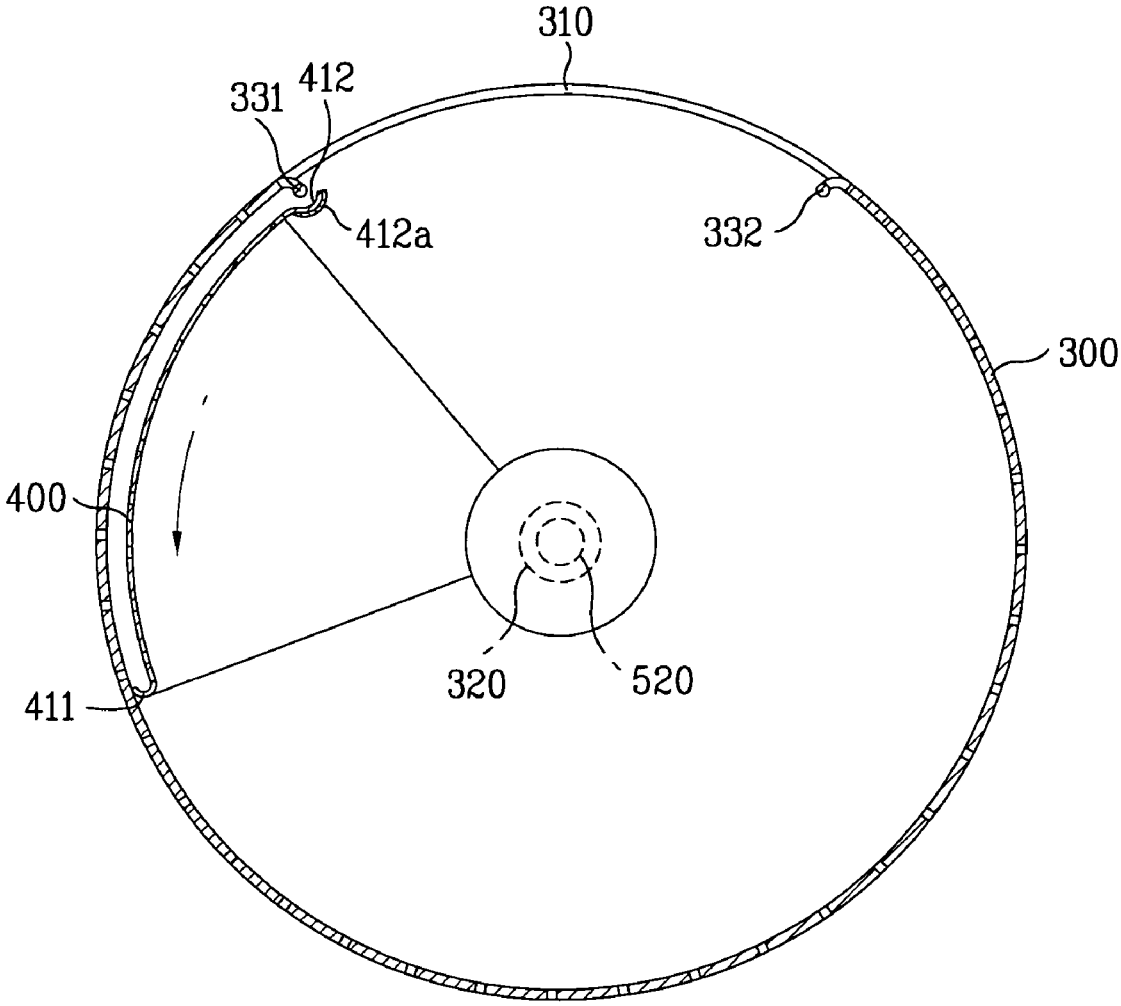
FIG. 7 is a sectional view of the drum door of the washing machine in accordance with the embodiment of the present invention, in an opened state.

When a control signal is applied to the driving motor 510 under the above state, as shown in FIG. 7, the drum door 400 moves in the circumferential direction of the drum 300, thereby opening the opening 310 of the drum 300.

The above-described washing machine of the present invention has several effects, as follows.

First, a space occupied by the drum door for taking laundry into and out of the washing machine is minimized, and the drum door does not obstruct the taking of the laundry into and out of the washing machine.

Second, since the drum door is automatically opened and closed, the laundry is conveniently taken into and out of the washing machine.

Third, since the alignment unit aligns the opening of the drum to coincide with the opening of the tub, the reliability of operating the washing machine is assured.

Fourth, since the drum and the drum door are driven by one motor and the clutch unit for selectively rotating the drum is prepared, the drum door is smoothly opened and closed.

It will be apparent to those skilled in the art that various modifications and variations can be made in the present invention without departing from the spirit or scope of the inventions.

Thus, it is intended that the present invention covers the modifications and variations of this invention provided they come within the scope of the appended claims and their equivalents.

What is claimed is:

1. A washing machine comprising:

a tub fixedly installed in a cabinet;

a drum rotatably installed in the tub for containing laundry, and provided with an opening formed through a cylindrical part thereof so that the laundry is taken into and out of the drum through the opening;

a drum door provided at the opening of the drum, and moving in the inner circumferential direction of the drum relative to the drum to open and close the opening of the drum;

a driving unit for rotating the drum, the drum door being connected to the driving unit to automatically open and close the opening of the drum after finishing washing the laundry; and a clutch unit for selectively interconnecting the driving unit and the drum to selectively transmit driving force of the driving unit to the drum in washing and dehydrating the laundry.

2. The washing machine as set forth in claim 1, wherein the drum door rotates centering on a rotary axis of the drum to open and close the opening of the drum.

3. The washing machine as set forth in claim 1, wherein the driving unit comprises:

a driving motor; and a door driving shaft, one end of which is connected to a rotor of the driving motor and the other end of which is connected to a rotary center of the drum door, to transmit the driving force of the driving motor to the drum door.

4. The washing machine as set forth in claim 3, wherein the drum comprises a drum driving shaft, one end of which is connected to a rotary center of the drum and the other end of which is selectively connected to the driving unit by the clutch unit, and being concentric with the door driving shaft.

5. The washing machine as set forth in claim 4, wherein the drum door is movable along the inner circumferential surface of the drum in the circumferential direction, and the door driving shaft passes through the drum driving shaft in the axial direction.

6. The washing machine as set forth in claim 5, wherein the clutch unit is installed between the driving motor and the drum driving shaft such that the clutch unit moves in the axial direction of the drum driving shaft, transmits the driving force of the driving unit to the drum driving shaft so that the drum driving shaft is rotated simultaneously with the rotation of the door driving shaft, when the washing machine is operated in washing and dehydration modes, and interrupts the transmission of the driving force of the driving motor to the drum driving shaft, when the drum door is opened.

7. The washing machine as set forth in claim 5, wherein the clutch unit comprises:

a coupler installed between the driving motor and the drum driving shaft such that the coupler moves in the axial direction of the drum driving shaft, to selectively interconnect the drum driving shaft and the door driving shaft; and a coupler driving portion for moving the coupler.

8. The washing machine as set forth in claim 7, wherein the coupler moves in the axial direction of the drum driving shaft by the coupler driving portion under the condition that the coupler is connected to the drum driving shaft by serrations, and is selectively connected to the door driving shaft.

9. The washing machine as set forth in claim 8, wherein one end of the coupler is separated from the door driving shaft and the other end of the coupler is connected to one end of the tub so that the position of the opening of the drum is not changed when the drum door is opened.

10. The washing machine as set forth in claim 9, the coupler comprises:

a first serration formed on one end of the coupler and selectively connected to a driving serration formed in the door driving shaft;

a second serration engaged with a serration formed in the drum driving shaft; and a third serration formed on the other end of the coupler and selectively connected to a fixing serration formed in one end of the tub.

11. The washing machine as set forth in claim 7, wherein the coupler driving portion comprises at least one electromagnet for moving the coupler to control the interconnection between the coupler and the door driving shaft.

12. The washing machine as set forth in claim 7, wherein the coupler driving portion comprises:

at least one electromagnet formed on one of the tub and the coupler;

a magnetic member formed on the other one of the tub and the coupler for moving the coupler in one direction by the electromagnetic interaction with the electromagnet; and an elastic member, one end of which is supported by the coupler and the other end of which is supported by the rotor of the driving motor.

13. The washing machine as set forth in claim 12, wherein the magnetic member moves the coupler when current is applied to the electromagnet, cuts the interconnection between the coupler and the driving unit, and interconnects the coupler and one end of the tub so as to prevent the rotation of the drum driving shaft when the drum door is opened.

14. The washing machine as set forth in claim 1, further comprising an alignment unit for aligning the opening of the drum to coincide with an opening formed through the tub.

15. The washing machine as set forth in claim 1, further comprising:

at least one latching protrusion formed on one edge of the opening of the drum; and at least one latching hook formed on one edge of the drum door and latched onto the latching protrusion when the drum door is closed.

16. The washing machine as set forth in claim 15, further comprising:

at least one subsidiary latching protrusion formed on the other edge of the opening of the drum; and at least one subsidiary latching hook formed on the other edge of the drum door and latched onto the subsidiary latching protrusion.

17. The washing machine as set forth in claim 16, wherein the drum door is provided in the drum.

18. The washing machine as set forth in claim 17, further comprising a weight provided on the subsidiary latching hook for separating the subsidiary latching hook from the subsidiary latching protrusion by its own weight when the drum is stopped and connecting the subsidiary latching hook to the subsidiary latching protrusion by the centrifugal force when the drum is rotated.

* * * * *